US006167661B1

(12) United States Patent
Christensen

(10) Patent No.: US 6,167,661 B1
(45) Date of Patent: Jan. 2, 2001

(54) WINDOW, IN PARTICULAR FOR MOUNTING IN AN INCLINED ROOF SURFACE

(75) Inventor: Jan Vilhelm Christensen, Vestbirk (DK)

(73) Assignee: Velux Industri A/S, Søborg (DK)

( * ) Notice: Under 35 U.S.C. 154(b), the term of this patent shall be extended for 0 days.

(21) Appl. No.: 09/297,045

(22) PCT Filed: Nov. 14, 1997

(86) PCT No.: PCT/DK97/00520

§ 371 Date: Apr. 28, 1999

§ 102(e) Date: Apr. 28, 1999

(87) PCT Pub. No.: WO98/22684

PCT Pub. Date: May 28, 1999

(30) Foreign Application Priority Data

Nov. 19, 1996 (DK) ..... 1320/96

(51) Int. Cl.[7] ..... E04B 7/18
(52) U.S. Cl. ..... 52/200; 52/210
(58) Field of Search ..... 52/200, 210

(56) References Cited

U.S. PATENT DOCUMENTS 4,776,141 10/1988 Powell .
4,972,638 * 11/1990 Minter ..... 52/200
5,207,036 * 5/1993 Sampson et al. ..... 52/72

FOREIGN PATENT DOCUMENTS 2 700 793 A1 7/1994 (FR) .

* cited by examiner

*Primary Examiner*—Richard Chilcot
*Assistant Examiner*—Patrick J. Chavez
(74) *Attorney, Agent, or Firm*—Venable; John P. Shannon

(57) ABSTRACT

A window for mounting in an inclined roof surface has a frame structure and a sash structure, which is hingedly connected (13–15;51–53) with the frame structure for pivoting about a horizontal axis relative thereto, and in which an insulating pane (3;33) is mounted. The top, bottom and side members (1,2,4,5;31,32,34,35) of the frame and sash structures are made from wood profiles with exterior cladding members (16–18;46,48) of weather-protecting material which, in the closed position of the window, overlap the spaces between the frame and sash structures and the hinge connection between the structures. The top, bottom and side members (1,2;31,32) of the frame structure are constituted by profiles with substantially parallelogram-shaped cross section with exterior edge faces (6;36) positioned in a common plane, with which common plane the adjacent interior and exterior opposite side faces (7,8;37,38) of the profile cross section form respectively an angle exterior to the parallelogram-shaped cross section and an angle interior to the parallelogram-shaped cross section in a range of 95 to 140°.

7 Claims, 2 Drawing Sheets

WINDOW, IN PARTICULAR FOR MOUNTING IN AN INCLINED ROOF SURFACE

BACKGROUND OF THE INVENTION

1. Field of the Invention

The present invention relates to a window, in particular for mounting in an inclined roof surface, comprising a frame structure and a sash structure, which is hingedly connected with the frame structure for pivoting about a horizontal axis relative thereto, and in which an insulating pane is mounted, the top, bottom and side members of the frame and sash structures being made from wood profiles with exterior cladding members of weather-protecting material which, in the closed position of the window, overlap the spaces between the frame and sash structures and the hinge connection between the structures.

2. Description of Related Art

Windows, in which the frame and the sash are composed by wood profiles and exterior cladding members for protection thereof, are well-known, i.a. from U.S. Pat. No. 4,972,638, and are widely used because they are maintenance-free on account of the good weather-protection and their appearance which is both from the outside and from the inside attractive from an aesthetic point of view.

In particular the desire to protect the wood profiles against weather influence has in the prior art occasioned complicated and expensive solutions.

BRIEF SUMMARY OF THE INVENTION

The object of the invention is to provide a window of the type mentioned by way of introduction, which apart from considering the demands made in respect of weather-protection is of a simple construction, which at the same time gives a high degree of utilization of the materials used.

This object is met according to the invention by a window, which is characterized in that the top, bottom and side members of the frame structure are constituted by profiles with substantially parallelogram-shaped cross section with exterior edge faces situated in a common plane, with which the adjacent opposite side faces of the profile cross section form an angle of 95 to 140°.

This embodiment provides the desired simple construction and good protection of the interior parts of the window. Furthermore, the parallelogram-shaped cross section gives a bigger stability in the corners of the frame structure compared to a rectangular cross section of the same area, which makes it possible to manufacture the members of the frame structure with comparatively smaller dimensions. Furthermore, the parallelogram-shaped design of the wood profiles of the frame structure provides an increased total light incidence in relation to a window, in which the side faces of the frame structure extend perpendicularly to the sash plane. Finally, the advantage is obtained that exchange of accessories, like roller blinds and insect nets, is simplified, as the very access to the window is facilitated by the oblique interior sides of the frame structure.

The pivot axis of the sash structure is in an embodiment positioned substantially in the middle of the window for providing a pivoting window, and the exterior cladding members above the hinge connection are connected with the frame structure and, below the hinge connection, with the sash structure. By this position of the exterior cladding members, a good protection is achieved without impeding the pivoting movement of the window.

In a further development which is simple in respect of manufacture the hinge connection comprises two hinges positioned opposite one another at the side members of the frame and sash structures, each hinge comprising two hinge parts, one of which is fastened to said exterior edge face of the side members of the frame structure, whereas the other one is fastened to an adjacent side edge face of the side members of the sash structure.

In an alternative embodiment the sash structure is top-hung relative to the frame structure and its top, bottom and side members are constituted by profiles with substantially parallelogram-shaped cross section.

The interior side faces of the sash profiles may flush with the interior side faces of the profile cross section of the top, bottom and side members of the frame structure.

In a further development of this embodiment the hinge connection between the sash and frame structures is constituted by a V-shaped hook member with a downwards facing opening on a cladding member connected with the top member of the sash structure, and a projecting wall portion engaging said hook member of an angled fitting which is fastened to the top member of the frame structure.

With a view to obtaining a simplified mounting and dismounting of the window, while at the same time securing a retaining of the sash structure to the frame in the normal opening angle range of the sash, holding means are fastened to at least one adjacent pair of the side members of the frame and sash structure, which holding means, within a predetermined opening angle range for the sash structure calculated from the closing position, hold the V-shaped hook member and said projecting wall portion in mutual engagement, but which by turning of the sash structure beyond said opening angle range allow dismounting of the sash structure relative to the frame structure.

The invention will now be explained in detail in the following with reference to some exemplifying embodiments as shown in the accompanying drawings, in which

DETAILED DESCRIPTION OF THE INVENTION

Figure 1:
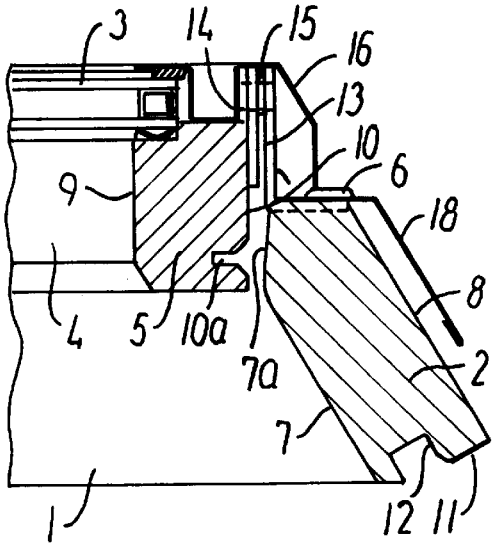
FIG. 1 is a sectional view through the lower portion of the side members of the frame and sash structures in a window, which is hinged about its centre axis, FIG. 2 a similar view through the upper portion of the window in FIG. 1.
Figure 2:
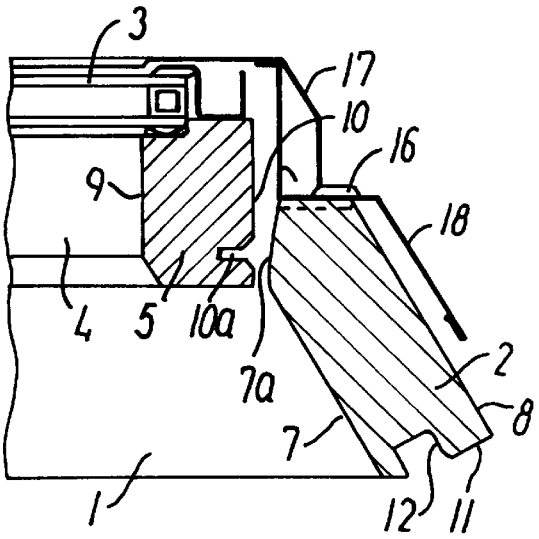

In the embodiment shown in FIGS. 1 and 2 of the drawings a roof or skylight window comprises according to the invention a frame structure with a top member 1, side members 2 and a bottom member not shown and a relative thereto openable sash structure, in which an insulating pane 3 is framed between a top member 4, side members 5 and a bottom member not shown. The top, bottom and side members of the frame and sash structures are all designed as wood profiles.

The frame wood profiles are made with a substantially parallelogram-shaped cross section, in which the exterior edge faces 6 of the profiles are positioned in a common plane, with which the adjacent opposite side faces 7 and 8 of the profile cross section form an angle of for instance 95 to 140°. This profile cross section, which gives the structure the shape of a low frustum of a pyramid, provides an advantageous possibility of making frame structures with oblique interior sides, which is desirable on account of the mounting of various types of accessories, like for instance roller blinds and insect nets, and a minimum consumption of material. The sash wood profiles are, however, made in a traditional manner with a rectangular cross section with parallel side faces 9 and 10.

In the embodiment shown the interior side face 7 is, however, bevelled to form an edge face 7*a* substantially perpendicular to the exterior edge face 6, said edge face 7*a* facing the exterior side face 10 of the sash side member and serving as abutment face for a sealing not shown, which is secured in an oppositely positioned groove 10*a*. The bottom face 11 is likewise bevelled, for instance for reasons of mounting, and comprises in view of the mounting a groove 12 for receiving a tongue for the formation of a tongue-and-groove joint with a subjacent roof structure or connection with a lining.

The sash structure is hingedly connected with the frame structure by means of a hinge with two hinge members, one of which is a substantially L-shaped bracket 13 fastened to the exterior edge face 6 of the frame side member 2, and the other one is a plate 14 secured to the exterior side face 10 of the sash side member 5. The bracket 13 and the plate 14 are connected with each other through a pin 15 effecting the hinge connection between sash and frame.

With a view to protecting the interior parts of the window exterior cladding members have been mounted, the cladding members 16 below the window as shown in FIG. 1 being mounted on the sash structure and the cladding members 17 above the hinge as shown in FIG. 2 being mounted on the frame structure. This makes it possible to unimpededly pivot the lower portion of the sash outwards and the upper portion inwards during opening of the window. Furthermore, cladding members 18 may be secured to the frame for protection of said frame, and below said cladding members a flashing known per se is passed upwards with a view to a weather-proof connection between the window and the surrounding roofing material.

Figure 3:
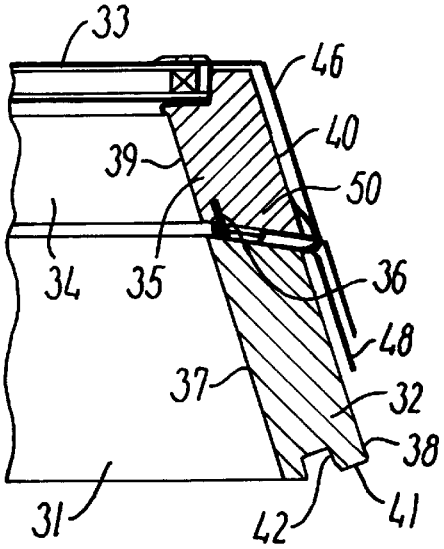
FIG. 3 shows in an alternative embodiment a sectional view through the side members of the frame and sash structures of a top-hung window according to the invention.
Figure 4:
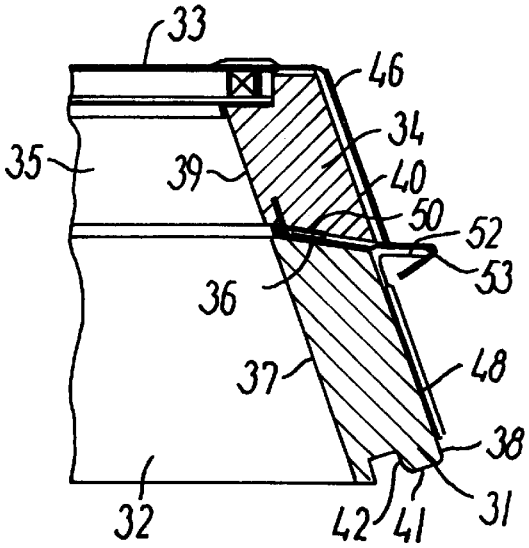
FIG. 4 is a sectional view through the top members of the window in FIG. 3.

In FIGS. 3 and 4 an alternative embodiment is shown, in which the sash structure is top-hung relative to the frame structure. When describing parts with identical or analogous function, 30 has been added to the reference numbers used in connection with the description of the embodiment shown in FIGS. 1 and 2.

The top member 34, side members 35 and bottom member (not shown) of the sash structure are here made as profiles with substantially parallelogram-shaped cross section, the interior side faces 39 of which are flushing with the interior side faces 37 of the frame profiles. The sealing between the sash and the frame is established by means of a circumferential sealant strip 50 fastened to the edge groove 36 of the sash profiles.

The exterior cladding members 46 are made as substantially L-shaped members which are secured to the upper side of the sash structure and extend in parallel with the exterior side faces 40 of the sash profiles, said cladding members sealing against the sealant strip 50 and overlapping the interspace between sash and frame and extending somewhat beyond the exterior side faces 38 of the frame profiles, a cladding member 48 being provided for further protection of the frame.

The sash and frame structures shown make it in an advantageous manner possible to make the top hinge of the window integral with the top members 31 and 34 of the frame and sash structures, respectively.

To this end a fitting member 51 with a pivot-forming part in the form of a projecting wall portion 52 may be connected with the cladding member 48 for the frame top member 31, whereas a substantially V-shaped hook member 53 is integral with the L-shaped cladding member 46 for the sash top member, said hook member being hitched on the projecting wall portion 52 and having an opening angle in the range of 20 to 30°.

Figure 5:
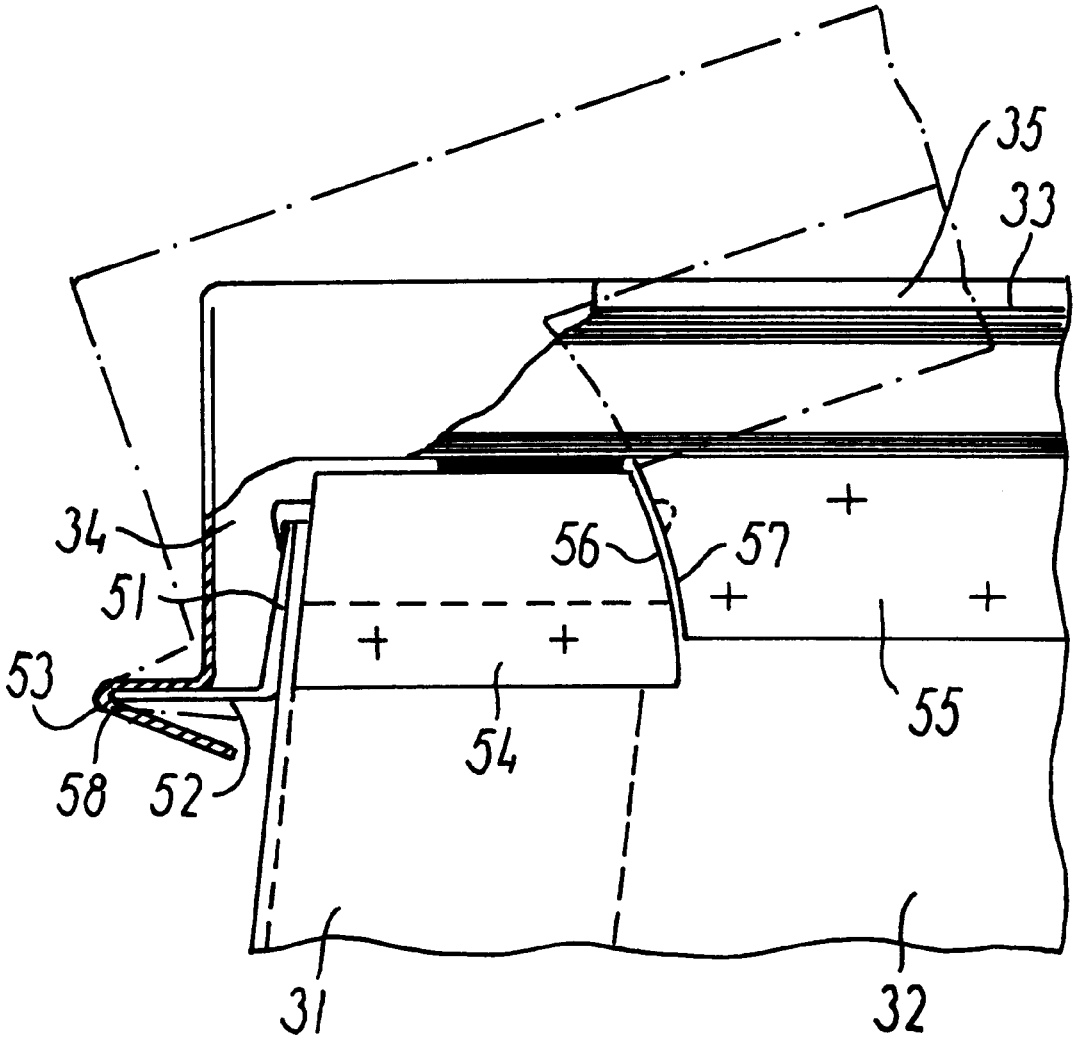
FIG. 5 shows a detail of the embodiment shown in FIGS. 3 and 4.

To keep the hook member 53 and the projecting wall portion 52 in mutual engagement and to make a turning of the sash structure possible into a ventilating position, holding means, for instance in the form of blocks 54 and 55 of a wear-resisting plastics material, may, as shown in FIG. 5, be fastened to adjacent pairs of side members of the frame and sash structures with part-cylindrical guide surfaces 56 and 57 with axis in the pivot axis 58 of the hinge. Within an opening angle range which is smaller than the opening angle of the V-shaped hook member, the holding means will keep the hinge parts in mutual engagement, while they, by turning of the sash structure beyond this opening angle range to the position shown in dashed line in FIG. 5, will disengage and thus allow an easy dismounting of the sash structure relative to the frame structure.

What is claimed is:

1. A window, in particular for mounting in an inclined roof surface, comprising a frame structure and a sash structure, which is hingedly connected (13–15;51–53) with the frame structure for pivoting about a horizontal axis relative thereto, and in which an insulating pane (3;33) is mounted, the top, bottom and side members (1,2,4,5;31,32,34,35) of the frame and sash structures being made from wood profiles with exterior cladding members (16–18;46,48) of weather-protecting material which, in the closed position of the window, overlap the spaces between the frame and sash structures and the hinge connection between the structures, characterized in that the top, bottom and side members (1,2;31,32) of the frame structure are constituted by profiles with substantially parallelogram-shaped cross section with exterior edge faces (6;36) positioned in a common plane, with which the adjacent interior and exterior opposite side faces (7,8;37,38) of the profile cross section form respectively an angle exterior to the parallelogram-shaped cross section and an angle interior to the parallelogram-shaped cross section in a range of 95 to 140°.

2. A window according to claim 1, characterized in that the pivot axis is positioned substantially in the middle of the window for providing a pivoting window, and in that the exterior cladding members (17) above the hinge connection (13–15) are connected with the frame structure and below the hinge connection with the sash structure.

3. A window according to claim 2, characterized in that the hinge connection comprises two hinges positioned opposite one another at the side members (2,5) of the frame and sash structures, each hinge comprising two hinge parts, one of which (13) is fastened to said exterior edge face (6) of the side members (2) of the frame structure, whereas the other one (14) is fastened to an adjacent side edge face (10) of the side members (5) of the sash structure.

4. A window according to claim 1, characterized in that the sash structure is top-hung relative to the frame structure, and that its top, bottom and side members (34,35) are constituted by profiles with substantially parallelogram-shaped cross section.

5. A window according to claim 4, characterized in that the interior side faces (39) of the cross section of the sash profiles are flush with the interior side faces (37) of the profile cross section of the top, bottom and side members of the frame structure.

6. A window according to claim 4, characterized in that the hinge connection between the sash and frame structures is constituted by a V-shaped hook member (53) with a downwards facing opening on a cladding member (46) connected with the top member (34) of the sash structure, and a projecting wall portion (52), engaging said hook member (53), of an angled fitting (51) which is fastened to the top member (31) of the frame structure.

7. A window according to claim 6, characterized in that to at least one adjacent pair of the side members (32,35) of the frame and sash structures holdings means (54,55) are fastened, which, within a predetermined opening angle range for the sash structure calculated from the closing position, hold the V-shaped hook member (53) and said projecting wall portion (52) in mutual engagement, but which by turning of the sash structure beyond said opening angle range allow dismounting of the sash structure relative to the frame structure.

* * * * *